United States Patent [19]

Atherton

[11] Patent Number: 5,035,721

[45] Date of Patent: Jul. 30, 1991

[54] METHOD FOR BENEFICIATION OF LOW-RANK COAL

[75] Inventor: Linda Atherton, Los Altos, Calif.

[73] Assignee: Electric Power Research Institute, Inc., Palo Alto, Calif.

[21] Appl. No.: 330,424

[22] Filed: Mar. 30, 1989

[51] Int. Cl.[5] ..... C10L 9/08; C10L 9/00

[52] U.S. Cl. ..... 44/594; 44/501; 44/608; 44/626

[58] Field of Search ..... 44/626, 627, 501, 608, 44/594

[56] References Cited

U.S. PATENT DOCUMENTS

| | | | |
|---|---|---|---|
| 4,725,337 | 2/1988 | Green | 44/626 |
| 4,783,199 | 11/1988 | Bixel et al. | 44/501 |
| 4,828,575 | 5/1989 | Bellow, Jr. et al. | 44/501 |

*Primary Examiner*—Carl F. Dees

*Attorney, Agent, or Firm*—Flehr, Hohbach, Test, Albritton & Herbert

[57] ABSTRACT

A method is provided for removing moisture and improving the handling and storage characteristics or low-rank coal by demoisturizing the coal and rendering the coal surfaces hydrophobic, separating the fines and agglomerating the fines in a slurry.

10 Claims, 1 Drawing Sheet

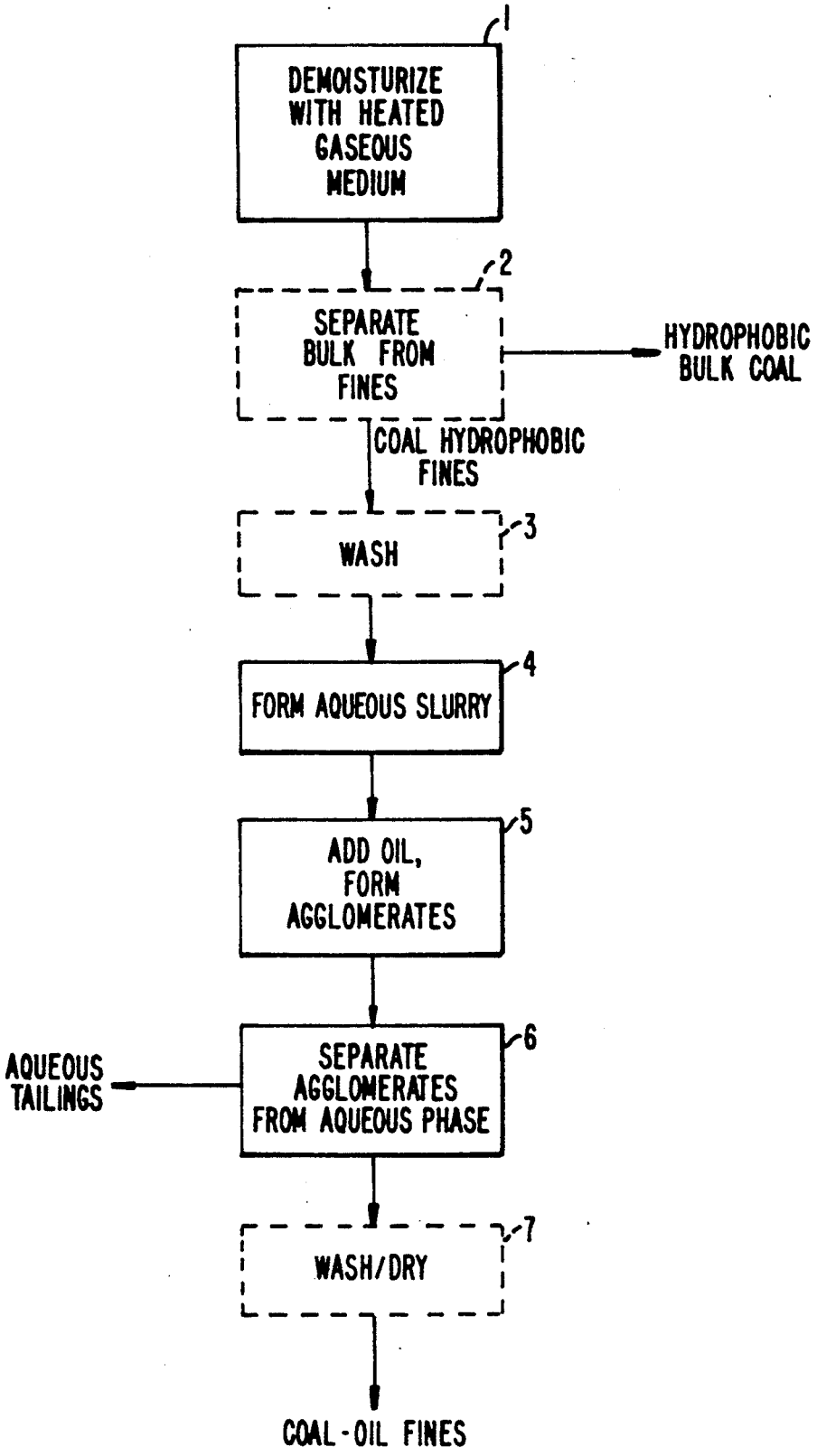
1
DEMOISTURIZE WITH HEATED GASEOUS MEDIUM
2
SEPARATE BULK FROM FINES
HYDROPHOBIC BULK COAL
COAL HYDROPHOBIC FINES
3
WASH
4
FORM AQUEOUS SLURRY
5
ADD OIL, FORM AGGLOMERATES
6
SEPARATE AGGLOMERATES FROM AQUEOUS PHASE
AQUEOUS TAILINGS
7
WASH/DRY
COAL-OIL FINES

METHOD FOR BENEFICIATION OF LOW-RANK COAL

The present invention is directed to a method for removing moisture and improving handling and storage characteristics of low-rank coal, such as lignite and subbituminous coal.

BACKGROUND OF THE INVENTION

Low-rank coals, such as lignite and subbituminous coal, usually contain relatively large quantities of water (i.e., about 10 to 50% by weight), which makes the economics of transporting and combusting these coals considerably more expensive than higher rank coals. Furthermore, this high moisture content makes the low-rank coals dangerous due to the possibility of spontaneous combustion during transportation or storage. Conventional drying processes prior to transportation or storage do not solve this problem because the coal will usually regain all of or most of the moisture from the atmosphere over a short period of time. In some cases the reabsorption of moisture causes the coal to become even more pyroforic than prior to drying. However, because of the generally low sulfur content of these low-rank coals, continued and increasing use of these coals may be unavoidable, due to the increasingly stringent regulations on sulfur emission in coal combusting installations. Therefore, there is a need for an inexpensive method for beneficiation of low-rank coals to remove moisture and improve transportation and storage characteristics which obviate or substantially reduces the above problems.

It is thus an object of the present invention to provide a method for beneficiating low-rank coals to remove moisture from these coals.

It is a further object of the present invention to recover surface-modified coal fines which are generated from coal de-watering processes.

It is yet another object of the present invention to provide a method for recovering by agglomeration surface-modified coal fines derived from low-rank coals.

These and other objects of the invention will become apparent to those skilled in the art from the following description, appended claims and drawings, as well as from the practice of the invention.

SUMMARY OF THE INVENTION

The present invention provides a method for moisture removal and improvement of the handling and storage characteristics of fines derived from low-rank coal comprising the steps of drying the bulk or pulverized low-rank coal by a treatment which modifies the coal surface to render it essentially hydrophobic, while also removing moisture from the coal, separating the dried coal into hydrophobic bulk coal and coal fines, wherein the fines comprise finely divided coal particles, ash and pyrite; separating the fines from the dried bulk coal and forming an aqueous slurry of the fines; mixing the aqueous slurry with about 2 to 15% by weight of a hydrocarbon liquid to form coal agglomerates in the presence of the aqueous phase of the slurry; then separating the agglomerates from the aqueous phase and inorganic material. Both the dried bulk coal and the coal agglomerates may be transported, stored and used as a carbonaceous fuel, both of which are substantially free of moisture, and low in sulfur and ash.

BRIEF DESCRIPTION OF THE DRAWINGS

The FIGURE is an illustration of the invention in a preferred embodiment.

DESCRIPTION OF THE PREFERRED EMBODIMENTS

In accordance with the present invention, a process for making a beneficiated coal product is provided which results in substantially moisture-free bulk hydrophobic coal and agglomerated coal fines, both of which are derived from a low-rank coal, and which do not substantially reabsorb water during storage or transportation. Furthermore, the beneficiated coal products derived from the coal fines according to the present invention are characterized by low sulfur content, low ash content and low pyrite content.

The present invention is suitable for employment on brown coal, lignite, subbituminous coal, and, in general, on any other types of coals which are known in the art as low-rank coals, including Wyodak subbituminous coal, Texas lignite, North Dakota lignite and European and Australian low-rank coals, and which are generally characterized by a high moisture content, usually from about 10 to 50% by weight based on weight of the wet coal.

The preferred method for demoisturizing and rendering the coal substantially hydrophobic is by a thermochemical process which uses low to moderate temperatures and inert gas or steam to heat the raw coal. This heating shrinks the moisture holding capillaries in the coal causing the destruction of moisture reaction sites (and possibly distilling some organic sulfur from the coal). No additives are used in this process. The alterations to the raw coal result in a product which is drier, cleaner burning and hydrophobic to the extent it no longer reabsorbs moisture, a process which would cause spontaneous combustion. As an additional benefit, the shrinkage of the capillaries in the coal causes the ash and pyrite particles to be easily separated from the coal. Simple gravity separation procedures then remove these impurities, further enhancing the quality of the coal. The details of a preferred drying and hydrophobic-surface inducing procedure for beneficiating low-rank coals are described, for example, in U.S. Pat. No. 4,725,337, the disclosure of which is incorporated by reference herein in its entirety. In this thermochemical process, 30–90% of the hydrocarbonaceous material is recovered as a beneficiated fuel derived from low-rank coal. However, 10–70% of the carbonaceous material treated as described in that patent is unrecovered fines whose surface properties have been modified sufficiently so that they behave more like high-rank coal. According to the present invention, these fines are recovered in a usable fuel form.

According to this preferred embodiment, low-rank coal, which may be, but is not necessarily, crushed and ground, is fed continuously at a controlled rate to a superheated gaseous demoisturizing medium. The temperature of the gaseous demoisturizing medium initiating this process is 850° F. and 15 inches pressure, (approximately 0.541 psi) although any temperature above the dew point of the superheated gaseous medium will suffice. Elevated pressures may be used in the case where steam is the demoisturizing medium.

When the coal is subjected to the demoisturizing medium, heat is transferred from the gas to the coal particles, thereby increasing the temperature of the coal particles to at least 300° F., preferably to about 450° F., for removing the moisture and vaporizing low boiling hydrocarbons. The preferred temperature is high enough that the carboxyl groups (which are hydrophilic) present in the coal may be destroyed.

As a consequence of the aforementioned heat transfer, moisture is substantially desorbed from the coal and superheated gases are produced. In the preferred embodiment, the temperature of these superheated gases is approximately 350° F. at 5 inches water column pressure (approximately 0.18 psi).

The composition of the superheated gases exiting the dryer, for subbituminous coal, is approximately: 75% $H_2O$ vapor, as steam; 20% $CO_2$; 0.3% organic sulfur compounds; 4.2% organic volatiles; and 0.5% other gases, such as $O_2$ and $N_2$.

The residence time of the coal within the dryer varies according to its particle size. The optimum residence times are less than fifteen (15) minutes for coal particles which are 1"-2" in size; less than eight (8) minutes for coal particles of 20 mesh to 1" in size; and less than three (3) minutes for coal particle fines less than 20 mesh. Because the largest particle establishes the residence time required to complete drying of all particles, economy for large scale processing is best realized by segregating particle sizes for separate processing.

According to another embodiment, the low-rank coal is demoisturized and rendered hydrophobic by a chemical grafting procedure wherein water and a soluble hydrocarbon fuel fraction serve as carriers for chemical grafting polymerization reactants which chemically react on the surface of the coal to cause the original water-wetted coal surface to become chemically altered by covalent bonding of polymerizable monomers to the surface of the coal. In this embodiment, the coal will first be prepared by grinding or crushing to a suitable coal particle size which is amenable to beneficiating. While not particularly critical, a useful size of the coal particles will be from about 48 mesh to 200 mesh, or finer, where the mesh sizes are based on U.S. Standard Screens. The coal surfaces become preferentially wetted by all qualities of water-insoluble carbon fuels (from aliphatic to aromatic quality and from heavy fuel oils to kerosene, without known qualification). Generally the chemical grafting polymerization reactants which are useful for such processes include polymerizable organic monomers having at least one unsaturated group which monomers are liquids at room temperatures such as styrene, dicyclopentadiene and other such monomers. The details of such drying and hydrophobic surface inducing procedures for beneficiating coal are known, for example, as shown in U.S. Pat. No. 4,332,593, the disclosure of which is incorporated by reference herein in its entirety.

After surface-modifying treatment, the hydrophobic coal particles will then be separated, if necessary, from the liquid carrier which results from the above identified demoisturizing processes. The nature of the liquid or gaseous carrier will depend of course upon the particular demoisturizing process which is utilized but in any event the hydrophobic coal particles may be separated therefrom by conventional methods such as by filtration, screening, or by using a conventional size classification device.

According to the preferred embodiment for demoisturizing the coal as described in U.S. Pat. No. 4,725,337, the bulk coal will be separated from the heretofore unusable fines. However, according to the alternative embodiment for demoisturizing as described in U.S. Pat. No. 4,332,593, the demoisturized coal will be provided in the form of fines suspended in an aqueous slurry, in which case, no further separation is required and the product may be directly used in the agglomeration process as described hereinbelow.

The hydrophobic coal fines will comprise the coal fines as well as ash, pyrite and other inorganic materials. Heretofore these coal fines have not usually been economically usable. However, according to the present invention these coal fines may be recovered and separated from the ash, pyrite and other inorganic materials by oil agglomeration. Of course, it will be realized that in some instances the initial demoisturizing process will already produce an aqueous slurry (such as by the grafting method described in U.S. Pat. No. 4,332,593) of these particles, thus the step of forming an aqueous slurry for agglomeration may be unnecessary.

It is preferred that an aqueous slurry of the fine coal particles, ash, pyrite and other inorganic materials be prepared and that to that slurry is added a hydrocarbon liquid, usually in an amount of 0.5 to 6% by weight of the coal in the slurry, to form coal-oil agglomerates which are separable from the remainder of the aqueous slurry and the inorganic material. The agglomerates will comprise the hydrocarbonaceous material, and the remainder of the aqueous slurry will contain the ash, pyrite and other inorganic materials. The water content of the aqueous slurry is not particularly critical and generally may be from 30 to 95% water (volume to weight of coal) and more preferably from about 40 to 90% water. There should be sufficient hydrocarbon oil added to the aqueous slurry to wet the surfaces of the coal fines and, upon agitation, agglomerate the coal particles and oil. This will be typically between 2 to 15% by weight of the coal fines, but the amount of hydrocarbon oil will also depend upon the particular type of hydrocarbon oil being employed and upon the size of the coal particles. Generally the amount of hydrocarbon oil may vary broadly within the range of about 0.5 to 45% by weight of the coal fines, but 3-8% will usually be sufficient, particularly when the fines have been demoisturized as described in U.S. Pat. No. 4,725,337. The agglomeration will typically be conducted at ambient temperature (50°-80° F.) and pressure. However, temperatures up to about 200° F. may be utilized. Suitable hydrocarbon oils for forming the agglomerates may be light and heavy refined petroleum fraction such as light cycle oil, heavy cycle oil, heavy gas oil, clarified oil, kerosene, heavy vacuum gas oil, residual oils, coal tar and other coal-derived oils. Preferably, light oils such as, diesel, light cycle oil, or other light oils will be utilized, since heavy oils normally used to agglomerate low-rank coal fines are not necessary in the present invention. The surface-modified coal fines behave more like high-rank coals. Mixtures of various hydrocarbon oils may be suitable, particularly when one of the oil materials is very viscous.

When the aqueous coal slurry is agitated with the hydrocarbon oil, it is believed that the hydrocarbon oil wets the coal particles and the hydrocarbon-wetted coal particles collide with one another under suitable agitation to form coal-oil agglomerates. This may be done suitably using stir tanks or other such agitating apparatus. After the coal-oil agglomerates are formed they may be readily recovered from the liquid slurry, i.e., separated from the liquid slurry which contains minerals such as ash and pyrite and other inorganics, typically associated with coal. The size of the agglomerate can vary depending upon the quantity of hydrocarbon oil used and the duration of agitation. The duration of agitation is typically ½–1 hour, but shorter or longer periods may be used. The resulting coal-oil agglomerates may be recovered from the slurry by using suitable screens or filters. Exemplary and preferred techniques for separating coal-oil agglomerates from the liquid slurry are described in commonly assigned copending applications, Ser. No. 156,541, filed Feb. 16, 1988 now U.S. Pat. No. 4,854,940 and Ser. No. 230,139, filed Aug. 9, 1988 now U.S. Pat. No. 4,966,608, the disclosures of which are incorporated herein by reference in their entirety. This separation step also allows for removal of some of the mineral matter such as the ash which remains in the aqueous tailings, so that the coal is thereby beneficiated.

In another embodiment, as a substitute for or in addition to the agglomeration process, a flotation step may be utilized to effect separation of the coal-oil particles from the liquid slurry. Conventional dissolved gas flotation techniques, dispersed gas flotation techniques or other flotation techniques may be utilized as is described, for example in U.S. Pat. No. 4,270,926, the disclosure of which is incorporated herein by reference in its entirety.

A preferred embodiment of the present invention is particularly described in connection with reference to the appended drawing. Referring to the FIGURE, in step 1, the raw low-rank coal is demoisturized and surface-modified. In step 2 the demoisturized coal is separated, if necessary, into bulk coal product and hydrophobic coal fines. In step 3 the fines from the demoisturizing step are washed, if needed, then mixed with water to form an aqueous slurry in step 4. In step 5 the oil is added and the slurry is agitated to form agglomerates. The agglomerates are separated in step 6 by conventional filtration or elutriation and then washed and dried in step 7, if desired, for storage, transportation or immediate use in a combustor. The aqueous tailings from step 6 containing the pyrite, ash, and other inorganic materials may be used as a recycled wash, discarded or treated for recovery of the inorganic material, if desired.

What is claimed is:

1. A method for moisture removal and improvement of handling and storage characteristics of a low-rank coal comprising the steps of (a) demoisturizing low-rank feed coal by a process whereby removal of moisture from said coal causes the outer surfaces of said coal to be rendered essentially hydrophobic thereby forming a mixture comprising hydrophobic surface-modified bulk coal and fines;

(b) separating said surface-modified bulk coal from said fines in said mixture, said fines comprising finely divided coal particles, ash and pyrite;

(c) forming an aqueous slurry of said fines;

(d) mixing said aqueous slurry with 2 to 15% by weight of a hydrocarbon oil to form coal agglomerates in said slurry;

(e) separating said agglomerates from said slurry.

2. A method according to claim 1 wherein said low-rank coal is selected from the group consisting of brown coal, lignite, subbituminous coal, and any combination of two or more of such coals or lignite.

3. A method for moisture removal and improvement of handling and storage characteristics of a low-rank coal comprising the steps of (a) pulverizing low-rank feed coal to a particle size from about 48 mesh to about 200 mesh;

(b) demoisturizing said pulverized coal by a process whereby removal of moisture from said coal causes the outer surfaces of said coal to be rendered essentially hydrophobic;

(c) forming an aqueous slurry of said hydrophobic coal;

(d) mixing said aqueous slurry with 2 to 15% by weight of a hydrocarbon oil to form coal agglomerates in said slurry; and (e) separating said agglomerates from said slurry.

4. A method according to claim 1 wherein said Step (a) comprises chemical grafting by covalent bonding of a polymerizable monomer to the surfaces of said coal.

5. A method according to claim 1 wherein said step (a) comprises contacting said coal with a superheated gaseous medium comprising water vapor, volatile organic compounds and/or carbon dioxide to heat said coal to a temperature of at least 300° F.

6. A method according to claim 1 wherein said hydrocarbon oil in Step (d) is selected from the group consisting of diesel, light cycle oil, heavy cycle oil, heavy gas oil, clarified oil, kerosene, heavy vacuum oil, residual oils, coal tar, coal-derived oils, and mixtures of any two or more thereof.

7. A method according to claim 1 further comprising the step of flotation of coal/oil particles from said slurry of Step (d), and separation of said particles from said slurry.

8. A method according to claim 1 wherein said step (d) comprises formation of said agglomerates by flotation.

9. A method according to claim 6 wherein said hydrocarbon oil comprises light cycle oil and/or diesel.

10. A method according to claim 9 wherein said hydrocarbon oil comprises diesel.

* * * * *